US012297615B2

(12) United States Patent
Femont et al.

(10) Patent No.: US 12,297,615 B2
(45) Date of Patent: May 13, 2025

(54) SELF-CLOSING FLOOD BARRIER

(71) Applicant: FLOODSOLUTIONS NV, Schoten (BE)

(72) Inventors: Anthony Femont, Schilde (BE); Oliver Femont, Schilde (BE)

(73) Assignee: FLOODSOLUTIONS NV, Schoten (BE)

( * ) Notice: Subject to any disclaimer, the term of this patent is extended or adjusted under 35 U.S.C. 154(b) by 38 days.

(21) Appl. No.: 18/011,642

(22) PCT Filed: Jun. 22, 2021

(86) PCT No.: PCT/EP2021/066968
§ 371 (c)(1),
(2) Date: Dec. 20, 2022

(87) PCT Pub. No.: WO2021/259919
PCT Pub. Date: Dec. 30, 2021

(65) Prior Publication Data

US 2023/0257954 A1 Aug. 17, 2023

(30) Foreign Application Priority Data

Jun. 22, 2020 (BE) ..... 2020/5458

(51) Int. Cl.
*E02B 3/10* (2006.01)

(52) U.S. Cl.
CPC ..... *E02B 3/104* (2013.01)

(58) Field of Classification Search
CPC ..... E02B 3/104; E02B 3/10; E02B 3/102
See application file for complete search history.

(56) References Cited

U.S. PATENT DOCUMENTS 5,725,326 A * 3/1998 Van den Noort ..... E02B 3/104 405/96
6,338,594 B1 * 1/2002 Adler ..... E02D 5/182
(Continued)

FOREIGN PATENT DOCUMENTS

| | | | |
|---|---|---|---|
| EP | 2315880 | B1 | 12/2015 |
| NL | 9201601 | A | 4/1994 |
| WO | 2015121229 | A1 | 8/2015 |

OTHER PUBLICATIONS

International Search Report from PCT Application No. PCT/EP2021/066968, Sep. 1, 2021.

(Continued)

*Primary Examiner* — Benjamin F Fiorello
(74) *Attorney, Agent, or Firm* — Workman Nydegger

(57) ABSTRACT

A self-closing flood barrier for protecting a hinterland against floods includes a housing having a water-side wall and a hinterland-side wall, a water inlet for letting in water into the housing, and a flood barrier element which is movable up and down in the housing. The flood barrier element acts as or includes a forcing element for causing a forced upward movement of the flood barrier element. The flood barrier element is wherein the self-closing flood barrier comprises a hinging clamping element which is hinge-mounted to the water-side wall, the hinging clamping element comprising a clamping piece which, in closed state of the self-closing flood barrier, is hinged against the flood barrier element, such that the flood barrier element is clamped in between the clamping piece and the hinterland-side wall.

15 Claims, 5 Drawing Sheets

(56) References Cited

U.S. PATENT DOCUMENTS

| | | | | |
|---|---|---|---|---|
| 10,612,204 | B2 * | 4/2020 | Terata | E02B 7/50 |
| 2009/0169302 | A1 * | 7/2009 | Alpern | E02B 3/104 405/33 |
| 2011/0110722 | A1 * | 5/2011 | Van den Noort | E02B 3/104 405/87 |
| 2013/0028660 | A1 * | 1/2013 | Haq | E02B 3/104 405/31 |
| 2015/0117952 | A1 * | 4/2015 | Gujer | E02B 7/36 405/96 |
| 2015/0337583 | A1 * | 11/2015 | Fukagawa | E06B 9/04 49/23 |
| 2016/0201281 | A1 * | 7/2016 | Roy | E02B 3/104 405/107 |
| 2016/0244927 | A1 * | 8/2016 | Adler | E02B 3/104 |
| 2016/0369469 | A1 * | 12/2016 | Kelly | E02B 7/205 |
| 2019/0177940 | A1 * | 6/2019 | Van den Noort | E02B 3/062 |

OTHER PUBLICATIONS

Search Report from Belgian Application No. 202005458, Mar. 9, 2021.

* cited by examiner

SELF-CLOSING FLOOD BARRIER

FIELD OF THE INVENTION

The present invention relates to a self-closing flood barrier, a method for using the self-closing flood barrier to prevent the hinterland from being flooded, and a method for assembling the self-closing flood barrier. The present invention more specifically relates to systems and methods based on self-closing flood barriers and their stability and/or leak resistance while being in a closed state.

BACKGROUND OF THE INVENTION

Self-closing flood barriers, which may be installed on, for example, a river bank or a sea dike, are flood barriers whereby a flood barrier element is automatically pushed upwards out of a housing in the case this housing fills up with water, and lowers when the water flows out of the housing. At low water, the flood barrier element is located underground in the housing, which is the open state of the self-closing flood barrier, so that the flood barrier element does not obstruct the passage of, for example, traffic. This is an advantage compared with conventional flood barriers, whereby a flood barrier element is permanently located above the ground and is immovable, so that, for example, the passage of traffic is also obstructed at low water. In the case of the self-closing flood barrier, the flood barrier element automatically rises upwards out of the ground at high water, creating a closed state of the self-closing flood barrier, so that the hinterland is protected against being flooded by the rising water. While in closed state, the self-closing flood barrier, in principle, offers the same protection against floods for the hinterland as a conventional flood barrier. For a self-closing flood barrier in closed state, the stability of the flood barrier element is essential: if the flood barrier element can move or can partially tilt for example, water may possibly still flow from the one side to the other side of the flood barrier element, and, furthermore, this tilting causes, for example, wear and tear of the self-closing flood barrier.

EP2315880B1 describes a self-closing flood barrier. The automatic upward movement of a dam wall member out of a chamber underground is achieved by a forcing element with high buoyancy forcing the dam wall member upwards when the chamber fills up with water. The upward movement of the dam wall member is limited by a blocking element which forms a wide base of the dam wall member, and a top of the chamber contains a support block which narrows the passage relative to the rest of the chamber, so that the flood barrier element is prevented from floating out of the housing. The support block and the blocking element are thereby shaped such that, in closed state of the self-closing barrier, the blocking element and, thus, the dam wall member, experiences a forced lateral movement. This may, for example, be caused by the support block and the blocking element both having an angled wall oriented approximately parallel to each other: thus, in the closed position of the self-closing barrier, a part of the forced upward movement is caused by the forcing element converted into a forced lateral movement, so that the dam wall member is pushed against a housing wall, thus stabilising the dam wall member to a certain extent. This self-closing flood barrier is developed for force release in a direction, for example in case of permanently high water, but, in closed state of the self-closing barrier, the dam wall member turns out to be less stable, for example, in the case it is hit by a wave. In closed state of the self-closing barrier, this dam wall member is less stable at a restricted high water level too, so, when the water is only just high enough so that the flood barrier element is only just pushed out of the ground, because the forced upward movement exercised onto the dam wall member is restricted then, and, thus, the forced lateral movement exercised onto the dam wall member is restricted too.

So, in the current state of the art, there continues to be demand for a self-closing flood barrier whereby the flood barrier element is also stable in case of wave motion or at a restricted high water level.

SUMMARY OF THE INVENTION

It is an aim of embodiments of the present invention to provide a self-closing flood barrier, the flood barrier of which remains stable in closed state, also with wave motion and/or at a restricted high water level.

It is an advantage of embodiments according to the present invention that a substantially good seal or full seal may be obtained for a self-closing flood barrier, even if it is subject to wave motion or even at various water levels.

The above-mentioned aim is achieved by a system and method as described below.

In a first aspect, the present invention relates to a self-closing flood barrier for protecting a hinterland against floods. The self-closing flood barrier hereby comprises: a housing comprising a water-side wall and a hinterland-side wall, a water inlet for letting in water into the housing, and a flood barrier element which is movable up and down in the housing. The flood barrier element comprises a forcing element for causing a forced upward movement of the flood barrier element, or the flood barrier element itself acts as a forcing element for causing a forced upward movement of the flood barrier element. The self-closing flood barrier comprises a hinging clamping element hinge-mounted to the water-side wall: the hinging clamping element comprises a clamping piece which, in closed state of the self-closing flood barrier, is hinged against the flood barrier element, such that the flood barrier element is clamped in between the clamping piece and the hinterland-side wall.

It is an advantage of embodiments of the present invention that the hinging clamping element provides a function in the accurate sealing of the flood barrier.

It is an advantage of embodiments of the present invention that the hinging clamping element is configured for, by hinging, improving the accurate sealing of the flood barrier. The latter may be obtained by providing an accurate relative positioning of the flood barrier element so that accurate sealing is provided.

The housing is sufficiently large and shaped such that a large part of the flood barrier element, and preferably substantially the entire flood barrier element, may be withdrawn into the housing. In embodiments, the housing is located substantially fully or fully underground. In embodiments in which the housing is located substantially fully or fully underground, the flood barrier element, in open state of the self-closing flood barrier, is preferably also located substantially fully or fully underground.

In embodiments, the housing is surrounded at the bottom and the sides by, for example, sand, whereby the sand further supports the walls of the housing. In embodiments, the housing is made from a sturdy material, such as stone or concrete or composite or plastic, so that it is not damaged by collisions with the flood barrier element. The housing comprises a bottom in embodiments. In embodiments, the flood barrier element, in the open state of the self-closing flood barrier, is located as closely to the bottom of the housing as possible. In certain embodiments, the flood barrier element, in the open state of the self-closing flood barrier, touches the bottom of the housing.

In embodiments, the housing comprises four walls which, seen from above and approximately, form the four sides of a square or a rectangle. However, more or fewer walls, for example, three, five, six or more, or other shapes, for example, a triangle, a pentagon or a rhombus, as well as irregular shapes, are possible too. The walls may, in principle, take any shape, but are preferably substantially flat or fully flat. The walls of the housing may be oriented at an angle or vertically but are preferably oriented substantially vertically. The walls of the housing may have various heights but are preferably substantially equal in height. The walls comprise, in any case, a hinterland-side wall and a water-side wall, which are preferably equal in length and, in preferred embodiments, are oriented parallel to each other.

The self-closing flood barrier serves to protect a hinterland against floods from, for example, a flood plain, the flood plain comprising, for example, a watercourse, a lake, a sea, an ocean, or land which floods. In preferred embodiments, the hinterland-side wall of the housing is located closer to the hinterland than the water-side wall of the housing. The water-side wall of the housing is, in fact, preferably located closer to the flood plain than the hinterland-side wall.

At the top, the housing has an upper opening large enough and shaped such that the flood barrier element may fully or partially move through it. In certain embodiments, the upper opening comprises the top of the housing. In certain embodiments, the top of the housing comprises a partial closure, whereby the partial closure comprises the upper opening. In certain embodiments, the housing and the flood barrier element are shaped such that the flood barrier element cannot fully leave the housing. A part of the flood barrier element is, for example, narrow enough to move back and forth through the upper opening, but another part of the flood barrier element is wider than the upper opening of the housing, so that this part cannot pass through the upper opening and, thus, stays in the housing.

The water inlet, which serves to let water into the housing, may, for example, comprise the upper opening at the top of the housing. If water is at a higher level than the top of the housing, the water may thus flow into the housing. In certain embodiments, however, the water inlet may also be located in a wall of the housing, preferably in the water-side wall. Thus, water may possibly already flow into the housing before the water level is high enough to flow through the upper opening in the top. The water inlet may, for example, be in direct contact with the flood plain, so that the level of the water in the housing is equal to the level of the water in the flood plain. In certain embodiments, the water inlet is connected to elements enabling a more precise control of the water level in the housing relative to the water level of the flood plain, for example, by means of a passing element that only allows water to pass towards the housing once the flood plain has a certain water level. Thus, the flood barrier element may be prevented from moving upwards because water is let into the housing, while the water in the flood plain is still at such a low level that there is no danger yet of the hinterland being flooded. In certain embodiments, while the flood plain is at low water, the water flows out of the housing, for example, in the case that the water inlet is located low in the housing, because the water flows back to the flood plain via the water inlet, or by means of a pump which, for example, is connected to the water inlet.

The closed state of the self-closing flood barrier comprises the situation whereby the flood barrier element is partially, or preferably as much as possible, located outside of the housing. This is preferably the case when a large amount of water is present in the housing, for example when the housing is partially or fully filled with water. In the closed state, the flood barrier element thus blocks water from flowing from the flood plain to the hinterland. Thus, the flood barrier element must be substantially or fully non-waterpermeable. The flood barrier element preferably comprises a material capable of withstanding a high force which, for example, is exercised laterally onto the flood barrier element by the high water. The flood barrier element preferably comprises a material capable of withstanding the presence of water, in other words, the characteristics of which are not changed by the presence of water. The material is, for example, among other effects, substantially capable of withstanding oxidation, corrosion or rotting. Such a material may, for example, be composite, plastic, aluminium, or wood, but is not restricted hereby.

The flood barrier element comprises the forcing element which has a low density. If water is present in the housing, the water in the housing exercises a buoyancy onto the forcing element, in other words an upward force, so that the forcing element is forced upwards. The density of the forcing element is preferably lower than the density of water, and the density of the forcing element is greatly preferably substantially lower than the density of water. The density of the forcing element must be so low in any case, that the flood barrier element as a whole is forced upwards when water is present in the housing, so that a part of the flood barrier element protrudes above the water level in any case. In embodiments of the present invention, the forcing element comprises composite and/or plastic, and/or aluminium and/or wood.

The hinging clamping element is hinge-mounted to the water-side wall. In preferred embodiments, the hinging clamping element is mounted to the water-side wall as high as possible, such as substantially to the top of the water-side wall, but this is not essential. In open state of the self-closing flood barrier, the distance between the clamping piece and the hinterland-side wall is greater than the width of, in any case, a part of the flood barrier element. Thus, in open state of the self-closing flood barrier, the flood barrier element can move up and down along the clamping piece. However, in closed state of the self-closing flood barrier, the hinging clamping element hinges such that the clamping piece is hinged against the flood barrier element, so that the flood barrier element is clamped between the clamping piece and the hinterland-side wall. Thus, in embodiments of the present invention, the flood barrier element can no longer move up and down.

Furthermore, in certain embodiments, this flood barrier element is kept substantially stable by means of it being clamped in between the clamping element and the hinterland-side wall, so that the flood barrier element cannot tilt relative to the housing. This prevents, for example, that, in closed state of the flood barrier element, water from the flood plain side presses laterally against the flood barrier element, that the flood barrier element tilts, so that water can still flow over the flood barrier element.

In certain embodiments of the present invention, the self-closing flood barrier is characterised in that the hinging clamping element comprises a pressure element, whereby the hinging clamping element is arranged such that, when the pressure element is pressed, the clamping element hinges against the flood barrier element. In embodiments, the pressure element is hinge-mounted to the water-side wall, such that the pressure element, when pressure is exercised onto it, hinges relative to the water-side wall. In embodiments, the clamping element is attached to the pressure element, such that, as a result of the pressure element hinging, the clamping element hinges against the flood barrier element.

In certain embodiments of the present invention, in which the hinging clamping element comprises a pressure element, the self-closing flood barrier is characterised in that the flood barrier element comprises a bumper element which, in closed state of the self-closing flood barrier, serves to press against the pressure element. The pressure element allows to check when the flood barrier element must be clamped in. In embodiments having the pressure element and the bumper element, the flood barrier element can move up when it is forced upwards by the water: the bumper element may thereby exercise pressure onto the pressure element, following which the clamping piece hinges against the flood barrier element. Thus, the flood barrier element is clamped in between the clamping piece and the hinterland-side wall. So, the bumper element only causes pressure to the pressure element at high water, so that the flood barrier element is only clamped in at high water. The contact between the pressure element and the bumper element also simultaneously restricts the upward movement of the flood barrier element, so that the flood barrier element cannot fully leave the housing.

When the water level in the housing subsequently drops, the bumper element exercises little or no pressure any more onto the pressure element, so that the clamping piece unhinges from the flood barrier element, and so the flood barrier element can freely move down again.

In certain embodiments of the present invention, the pressure element of the hinging clamping element comprises a surface and the bumper element of the flood barrier element comprises a surface, whereby, in closed position of the self-closing flood barrier, said two surfaces touch each other. By the use of surfaces which make contact with each other and thereby have a large contact surface, the force per surface exercised onto each other by the elements is restricted, which is better for the durability of the materials used.

In certain embodiments of the present invention, the hinging clamping element, the housing and the flood barrier element are arranged such that the surface of the pressure element and the surface of the bumper element both are oriented approximately horizontally, either in open state or in closed state of the self-closing flood barrier. While the flood barrier closes, it may thus be prevented that said surfaces laterally partially touch each other, so that damage to one or both of the surfaces may be prevented.

In certain embodiments of the present invention, the clamping piece comprises a surface and the flood barrier element comprises a surface, whereby, in closed state of the self-closing flood barrier, said surfaces touch each other. By the use of surfaces which make contact with each other, the force per surface exercised onto each other by the elements is restricted, which is better for the durability of the materials used. Furthermore, a large contact surface is thus formed, which improves the stability of the flood barrier element in closed state of the self-closing flood barrier.

In certain embodiments of the present invention, the hinging clamping element, the housing and the flood barrier element are arranged such that the surface of the clamping piece and the surface of the flood barrier element are both oriented approximately vertically, either in open or in closed position of the self-closing flood barrier. While opening and closing, the flood barrier element moves preferably vertically only. Thus it may be prevented, during opening and closing of the flood barrier, that said surfaces partially touch each other at an angle, so that damage to either surfaces may be prevented.

In certain embodiments of the present invention whereby the hinging clamping element comprises the pressure element, the pressure element of the hinging clamping element and the clamping piece of the hinging clamping element are directly connected to each other and immovable relative to each other. Thus, the quantity of moving components is limited and the durability of the hinging clamping element is increased. The pressure element and the pushing element may, for example, be united in the same object, as in a corner element or in a block, whereby the object which may be used is not limited further.

In certain embodiments of the present invention, the flood barrier element comprises a closing element at the top which, in open state of the self-closing flood barrier, closes the upper opening of the housing. The closing element is thereby, in certain embodiments, preferably substantially equal in size, equal in size, or larger than the upper opening at the top of the housing. Thus, the upper opening of the housing, in open state of the self-closing flood barrier, is substantially or fully closed, so that the flood barrier element may fully disappear into the ground, without an opening being left thereby, through which dirt, such as, for example, sand or mud, may end up in the housing. In this manner, the closing element also facilitates the passing of traffic over the self-closing flood barrier in open state of the self-closing barrier.

In certain embodiments of the present invention, the flood barrier element comprises a substantially flat side for leaning against the wall of the housing. It is an advantage of embodiments of the present invention that the force onto the components at that side is spread across a large surface. Thus, the force per surface exercised onto the hinterland-side wall of the housing and onto the flood barrier element is restricted, which improves the durability of these components. Furthermore, the clamping of the flood barrier element is improved because there is a large flat contact surface of the flood barrier element with the hinterland-side wall. After all, a large contact surface is thus formed, which improves the stability of the flood barrier element in closed state of the self-closing barrier.

In certain embodiments of the present invention, the flood barrier element comprises a sealing element to the side of the flood barrier element which, in closed state of the self-closing barrier, is pressed against the hinterland-side wall. Thus, in closed state of the self-closing barrier, water is prevented from being able to flow between both sides of the flood barrier element.

In a second aspect, the present invention relates to a method for protecting a hinterland against floods by means of a self-closing flood barrier according to any of the embodiments of the first aspect of the present invention. The method comprises providing the self-closing flood barrier, installing the self-closing flood barrier below the bottom base surface, and letting water flow into the housing for forcing the flood barrier element upwards. As water is present in the housing, the flood barrier element is forced upwards, so that it partially leaves the housing. Thus, the flood barrier element prevents that water can flow between the flood plain and the hinterland.

In a third aspect, the present invention relates to a method for producing a self-closing flood barrier for protecting a hinterland against floods according to one of the embodiments of the first aspect of the present invention. The method comprises providing the following components: the housing, the water inlet, the flood barrier element, and the hinging clamping element. The method also comprises assembling said components so that the self-closing flood barrier is formed according to one of the embodiments of the first aspect of the present invention. Hereby, the housing may be provided in one piece or in several pieces, whereby, for example, the bottom and the walls and the top are provided separately and are subsequently assembled, whereby the housing is formed.

Specific and preferred aspects of the invention have been included in the attached independent and dependent claims. Features of the dependent claims can be combined with features of the independent claims and with features of further dependent claims such as indicated and not only as expressly brought forward in the claims.

To summarise the invention and the advantages achieved compared with the state of the art, certain aims and advantages of the invention were described above. It may be understood, of course, that not necessarily all these aims or advantages can be achieved by each specific embodiment of the invention. So, for example, it will be obvious to a person skilled in the art that the invention may be embodied or carried out in a manner which reaches or optimises one advantage or a group of advantages as presented herein, without thereby necessarily achieving other aims or advantages which may have been presented or suggested herein.

The above and other aspects of the invention will be apparent and clarified by reference to the embodiment(s) described below.

SHORT DESCRIPTION OF THE DRAWINGS

The invention will now be further described, by means of example, with reference to the associated figures wherein.

Figure 1A:
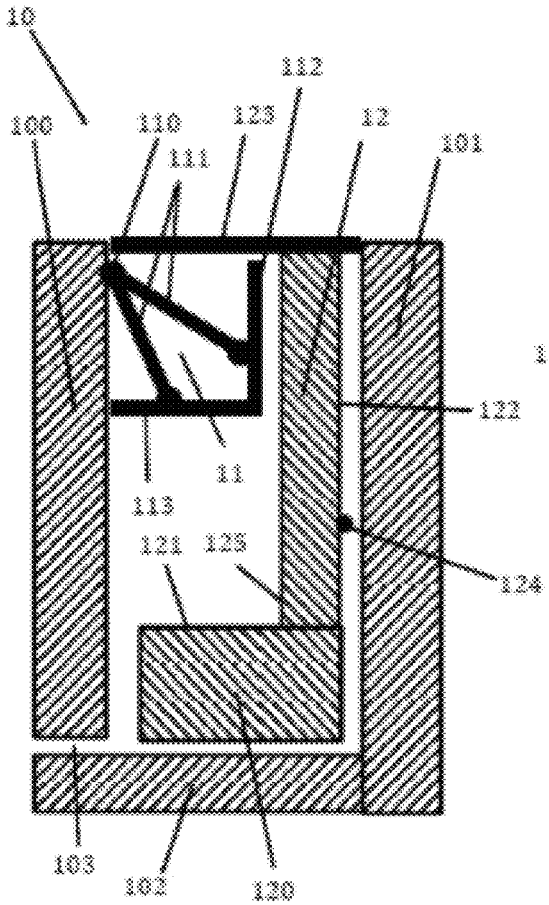
FIG. 1A and FIG. 1B show a side view of a self-closing flood barrier according to one of the embodiments of the present invention, in open and in closed state respectively.

The figures are only schematic and not restrictive. It is possible that the dimensions of some components have been exaggerated and have not been represented to scale in the figures for illustrative purposes. Dimensions and relative dimensions do not necessarily correspond with actual embodiments of the invention.

Reference numbers used in the claims cannot be interpreted to restrict the scope of protection.

In the various figures, the same reference numbers refer to the same or similar elements.

DETAILED DESCRIPTION OF ILLUSTRATIVE EMBODIMENTS

The present invention will be described in respect of special embodiments and with reference to certain drawings, however the invention will not be restricted to this but will only be restricted by the claims.

The terms first, second, third and the like in the description and in the claims are used to distinguish similar elements and are not necessarily used for describing an order, nor in time, nor in space, nor in ranking nor in any other manner. It should be understood that the terms used in this way are interchangeable in appropriate circumstances and that the embodiments of the invention described herein are suitable to work in a different order than described or indicated herein.

Furthermore, the terms top, bottom, above, in front of and the like used in the description and the claims are used for description purposes and not necessarily to describe relative positions. It should be understood that the terms used as such are interchangeable in given circumstances and that the embodiments of the invention described herein are also suitable for functioning according to different orientations than described or indicated here.

It should be noted that the term "comprises", as used in the claims, should not be interpreted as being restricted to the items described thereafter; this term does not exclude any other elements or steps. It may be interpreted as specifying the presence of the features, values, steps or components indicated being referred to, but does not exclude the presence or addition of one or several other features, values, steps or components, or groups thereof. So, the extent of the expression "a device comprising items A and B" should not be restricted to devices consisting of components A and B only. It means that in respect of the present invention, A and B are the only relevant components of the device.

Reference throughout this specification to "one embodiment" or "an embodiment" means that a specific feature, structure or characteristic described in connection with the embodiment has been included in at least one embodiment of the present invention. So, occurrence of the expressions "in one embodiment" or "in an embodiment" in various locations throughout this specification do not necessarily all need to refer to the same embodiment but may do so. Furthermore, the specific features, structures or characteristics may be combined in any suitable manner as would be clear to a person skilled in the art on the basis of this publication, in one or several embodiments.

Similarly, it should be appreciated that in the description of sample embodiments of the invention, sometimes various features of the invention are grouped together in one single embodiment, figure or description thereof intended to streamline the publication and to help the understanding of one or several of the various inventive aspects. This method of publication should therefore not be interpreted as a reflection of an intention that the invention requires more features than explicitly mentioned in each claim. Rather, as the following claims reflect, inventive aspects lie in fewer than all features of one single previously publicised embodiment. So, the claims following on from the detailed description have been explicitly included in this detailed description, with every independent claim being a separate embodiment of the invention.

Furthermore, while some embodiments described herein comprise some, but not other, features included in other embodiments, combinations of features from various embodiments are intended to be within the scope of the invention, and these form various embodiments as would be understood by the person skilled in the art. For example, in the following claims, any of the embodiments described may be used in any combination.

In the description provided here, a large number of specific details are raised. It may therefore be understood that embodiments of the invention may be embodied without these specific details. In other cases, well-known methods, structures and techniques are not shown in detail in order to keep this description clear.

In a first aspect, the present invention relates to a self-closing flood barrier for protecting a hinterland against floods. The self-closing flood barrier hereby comprises: a housing comprising a water-side wall and a hinterland-side wall, a water inlet for letting in water into the housing, and a flood barrier element which is movable up and down in the housing. The flood barrier element comprises a forcing element for causing a forced upward movement of the flood barrier element. Alternatively, the flood barrier element itself acts as forcing element. The self-closing flood barrier comprises a hinging clamping element hinge-mounted to the water-side wall: the hinging clamping element comprises a clamping piece which, in closed state of the self-closing barrier, is hinged against the flood barrier element, such that the flood barrier element is clamped in between the clamping piece and the hinterland-side wall. In a second aspect, the present invention relates to a method for protecting a hinterland against floods by means of a self-closing flood barrier according to any of the embodiments of the first aspect of the present invention. The method comprises providing the self-closing flood barrier, installing the self-closing flood barrier below the bottom base surface, and letting water flow into the housing for forcing the flood barrier element upwards.

FIG. 1A shows a side view of a self-closing flood barrier 10 in one of the embodiments according to the first aspect of the present invention, in open state. The self-closing flood barrier 10 comprises a housing having a water-side wall 100, a hinterland-side wall 101, and a bottom 102. The water-side wall 100 and the hinterland-side wall 101 are substantially flat, vertically oriented, and substantially equal in height. A water inlet 103 serves to let water into the housing. The self-closing flood barrier is in open state because there is no water in the housing: this is, for example, because the water in the flood plain is so low that there is no risk of flooding.

Figure 4:
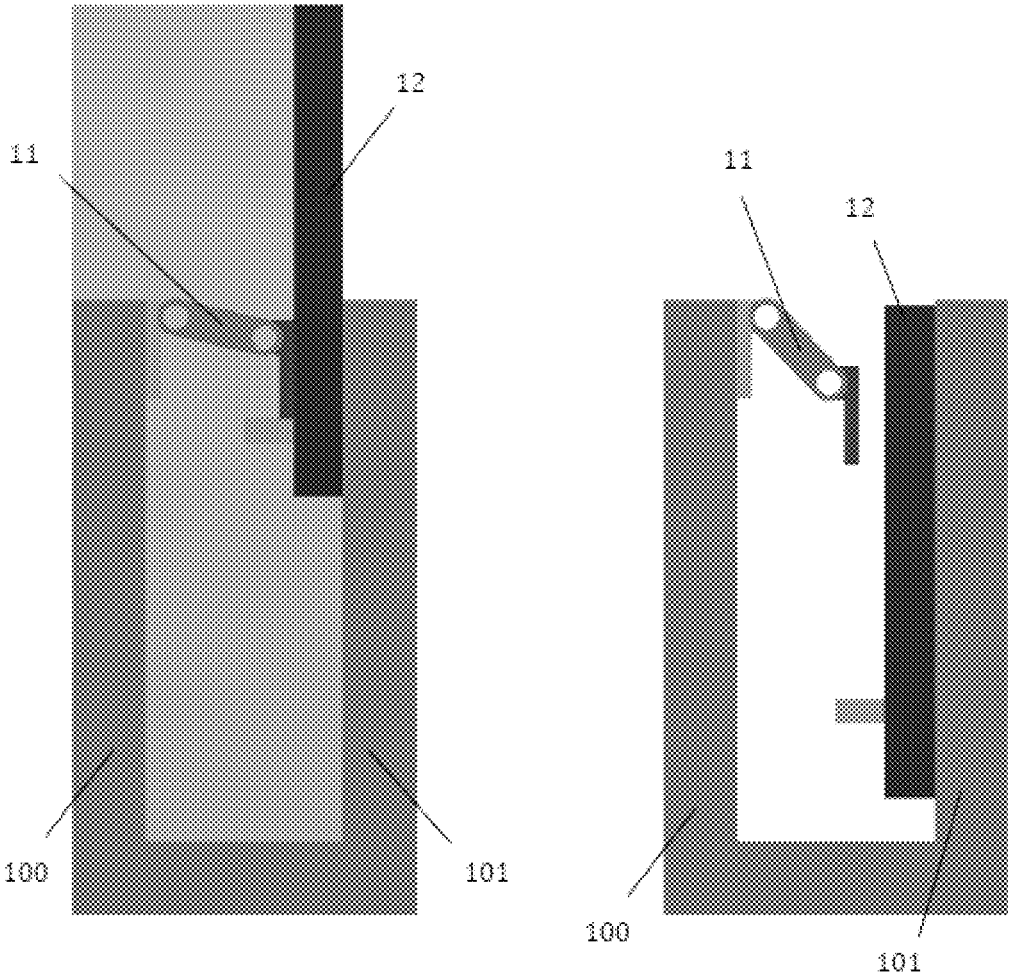
FIG. 4 illustrates a system having a wall to which a take-away element has been mounted, according to an embodiment of the present invention.

In the housing, a flood barrier element 12 is located, comprising a forcing element 120, a bumper element 121, a substantially flat side 122, a closing element 123, and a sealing element 124. The bumper element 121 comprises a part of the top of the forcing element 120. The housing is sufficiently large so that, in this embodiment, in the open state of the self-closing flood barrier, the full flood barrier element 12 is substantially located in the housing. The flood barrier element 12 may have a narrow part and a wide part, and may, in principle, move up and down in the housing, and move partially through the upper opening of the housing. Alternatively, the flood barrier element 12 may also be flat. In some embodiments, the flood barrier element 12 may comprise a take-away piece such as, for example, a block or a rod, which takes away the hinging part. This prevents that dirt remains on the forcing element. An example of this is shown for example in FIG. 4. The forcing element 120 has a low density, so that the forcing element may be forced upwards when there is water in the housing, so that the entire water element 12 is forced upwards. In this embodiment, the forcing element 120 is located at the bottom of the flood barrier element 12. However, the forcing element 120 may substantially comprise the entire flood barrier element 12. The closing element 123 closes the upper opening of the housing. The sealing element 124 is located at the substantially flat side 122 of the flood barrier element 12.

A hinging clamping element 11 is hinge-mounted to the waterland-side wall 100 of the housing via a hinge 110. The hinging clamping element 11 is thereby substantially attached to the top of the waterland-side wall 100. The hinging clamping element 11 comprises a clamping piece 112 and a pushing element 113 which, immovable relative to each other and perpendicular to each other, are connected to each other. The clamping piece 112 comprises a surface, and the pushing element 113 comprises a surface. In this embodiment, the hinging clamping element 11 also comprises rods 111 which connect the clamping piece 112 and the pushing element 113 with the hinge 110.

In open state of the self-closing flood barrier 10, the distance between the clamping piece 112 and the hinterland-side wall 101 is greater than the width of, in any case, a piece of the flood barrier element 12. Thus, the flood barrier element 12 may move up and down between the hinging clamping element 11 and the hinterland-side wall 101. However, the hinging clamping element 11 is arranged such that, if pushing occurs onto the pushing element 113 from below, the clamping element 11 hinges, so that the clamping piece 112 is hinged against a surface 125 of the flood barrier element 12. This surface 125 may be oriented vertically.

Figure 1B:
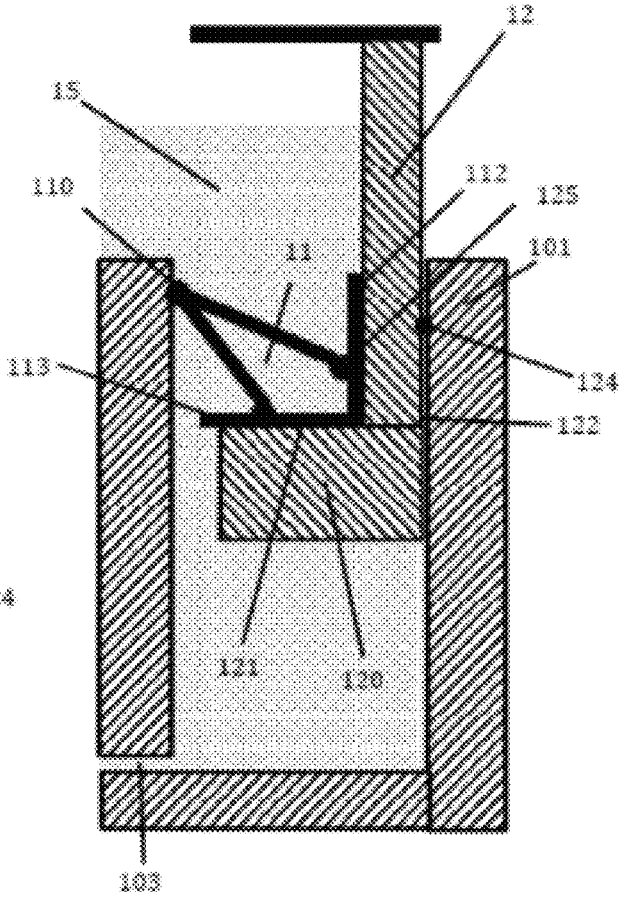

We now refer to FIG. 1B. According to the method according to the second aspect of the present invention, water 15 is let into the housing via water inlet 103. The water 15 exercises a buoyancy onto the forcing element 120, so that the entire flood barrier element 12 is forced upwards, whereby a part of the flood barrier element 12 moves out of the housing. The self-closing flood barrier 10 is thus in the closed state.

Due to the forced upward movement of the flood barrier element 12 and due to the upward buoyancy, which is exercised onto the forcing element 120, the bumper element 121 pushes against the pushing element 113. As a result of this, the hinging clamping element 11 hinges, by rotating around the hinge 110, such that the clamping piece 112 is hinged against the surface 125 of the flood barrier element 12. The flood barrier element 12 is thus pressed against the hinterland-side wall 101, so that the flood barrier element 12 is clamped between the clamping piece 112 and the hinterland-side wall 101.

The surface of the clamping piece 112, while in closed state, is oriented approximately vertically, and the surface of the pushing element 113, while in closed state, may be oriented approximately horizontally. As the bumper element 121 and the pushing element 113 comprise a horizontally oriented surface making contact with each other, the contact surface between the two is large and thus the force per surface exercised onto the elements is restricted, which may prevent damage to the elements. Furthermore, the pushing element 113 restricts the upward movement of the flood barrier element 12, so that the flood barrier element 12 cannot fully leave the housing.

As the surface of the clamping piece 112 is pressed against the surface 125 of the flood barrier element 12, whereby both surfaces are oriented vertically, there is a large contact surface between the clamping piece 112 and the flood barrier element 12. As the substantially flat side 122 of the flood barrier element 12 is pushed against the flat wall of the hinterland-side wall 101, there is also a large contact surface between the flood barrier element 12 and the hinterland-side wall 101. As the clamping thus occurs with two large contact surfaces which are furthermore oriented parallel to each other, the stability of the flood barrier element 12 against, for example, wave motion and various water levels is high. Thus, in certain embodiments, the flood barrier element 12 does not even tilt, for example, with wave motion or at various water levels, so that water is prevented from being able to flow from the flood plain to the hinterland.

Due to the sealing element 124 which is present between the flood barrier element and the hinterland-side wall, no water can flow between the flood barrier element and the hinterland-side wall, so that this too prevents water from being able to flow from the flood plain to the hinterland.

When the water 15 were to be let out of the housing, for example through the water inlet 103 if the water level of the flood plain is low, the buoyancy exercised onto the flood barrier element reduces, so that the force which the bumper element 121 exercises onto the pushing element 113, reduces. Thus, the clamping piece 112 of the hinging clamping element 11 may unhinge from the surface 125 of the flood barrier element 12. Thus, the flood barrier element 12 is no longer clamped between the clamping piece 112 and the hinterland-side wall 101, and the flood barrier element 12 may again move downwards and substantially fully re-enter into the housing.

Figure 2A:
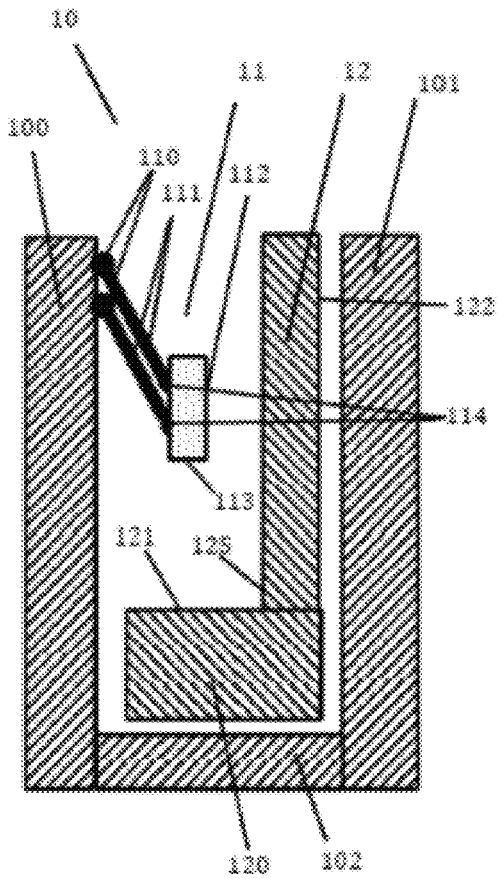
FIG. 2A and FIG. 2B show a side view of a self-closing flood barrier according to one of the embodiments of the present invention, in open and in closed state respectively.

An alternative embodiment of the self-closing flood barrier 10 according to the first aspect of the present invention is shown in FIG. 2A. The housing comprises a water-side wall 100, a hinterland-side wall 101, and a bottom 102. In this embodiment, the water inlet comprises the upper opening of the housing. In this embodiment, the hinging clamping element 11 is hinge-mounted to the water-side wall 100 with hinges 110. The pushing element 113 and the clamping piece 112 are part of a single block, which are connected via rods 111 with hinges 114 on the block to the hinges 110 on the water-side wall 100.

The hinging clamping element 11 is thereby arranged such that the surface of the pushing element 113, either in open state or in closed state of the self-closing flood barrier 10, is horizontally oriented. Alternatively, the surface may also be spherical, in order to have, for example, less friction. The bumper element 121 also comprises a surface oriented horizontally or angled. The advantage of this device is that the contact surface between the bumper element 121 and the pushing element 113, either in the open state or in the closed state of the self-closing barrier, is large each time, which restricts the force per surface exercised onto the elements, and thus promotes the durability of the elements.

The hinging clamping element 11 is also arranged such that the surface of the clamping piece 112, either in open state or in closed state of the self-closing flood barrier 10, is vertically oriented. The flood barrier element also comprises a surface 125 that is vertically oriented and to which the clamping piece 112 hinges against while in closed state. The advantage of this device is that the contact surface between the clamping piece 112 and the surface 125 of the flood barrier element 12, both while the self-closing flood barrier is closing and in closed state of the self-closing barrier, is large each time, which promotes the durability of the materials.

Figure 2B:
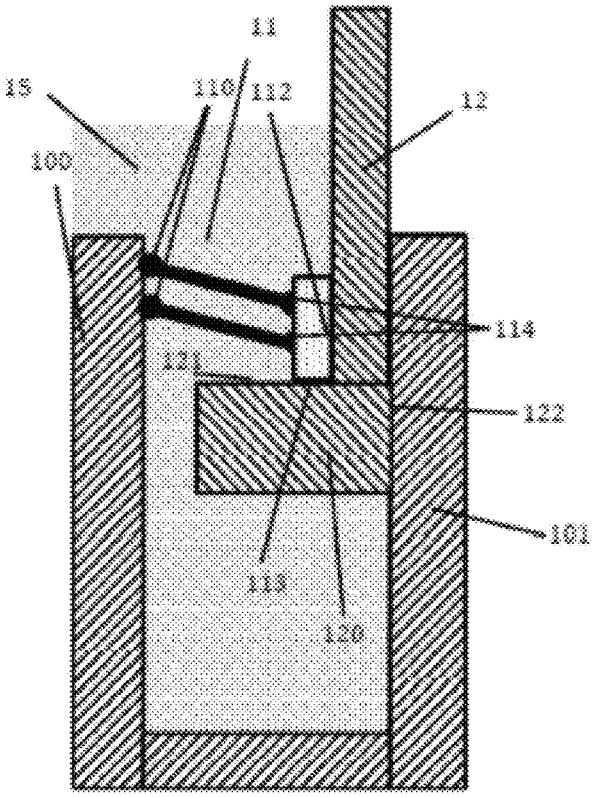

We now refer to FIG. 2B. Water 15 is let into the housing via the water inlet according to the method according to the second aspect of the present invention. The water 15 has thereby forced the forcing element 120, and thus the flood barrier element 12, upwards. A part of the flood barrier element 12 has thereby left the housing. The bumper element 121 has pushed against the pushing element 113, so that the hinging clamping element 11 has hinged. Thus, the clamping piece 112 has hinged against the surface of the 125 of the flood barrier element 12, so that the substantially flat side 122 of the flood barrier element 12 is pushed against hinterland-side wall 101. The flood barrier element 12 is thus clamped between the clamping piece 112 and the hinterland-side wall 101.

In this embodiment too, there is a large contact surface between the clamping piece 112 and the surface 125 of the flood barrier element 12, and also between the substantially flat side 122 of the flood barrier element 12 and the hinterland-side wall 101, so that the flood barrier element 12 will not tilt spontaneously with wave motion or at various water levels.

Figure 3A:
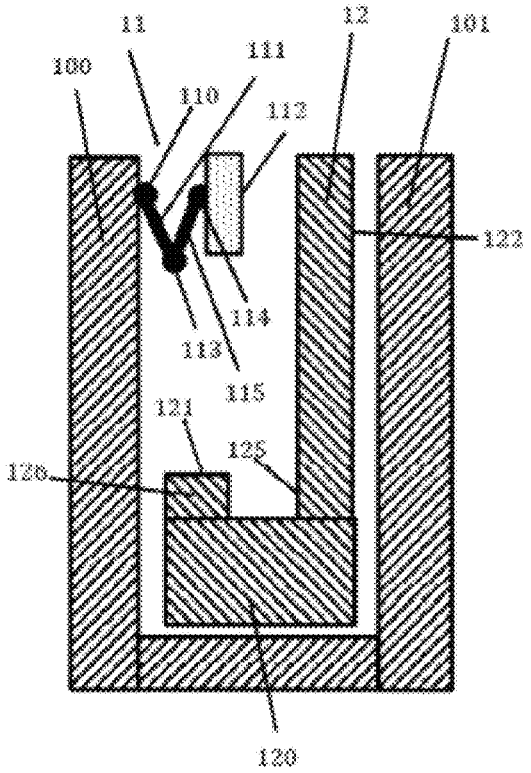
FIG. 3A and FIG. 3B show a side view of a self-closing flood barrier according to one of the embodiments of the present invention, in open and in closed state respectively.

Another alternative embodiment of the self-closing flood barrier 10 according to the first aspect of the present invention is shown in FIG. 3A in which the self-closing flood barrier 10 in an open state is shown. The housing comprises a water-side wall 100, a hinterland-side wall 101, and a bottom 102. In this embodiment, the water inlet comprises the upper opening of the housing. In this embodiment, the hinging clamping element 11 is hinge-mounted to the water-side wall 100 via a rod 111 with hinge 110. The hinging clamping element 11 is mounted to the water-side wall 100 as high as possible. In this embodiment, the pushing element 113 and the clamping piece 112 are not immobile relative to each other, but are hinge-connected to each other, whereby one hinge comprises the pushing element 113, and a second hinge 114 is mounted to a block which comprises clamping piece 112, and whereby the two hinges are connected to each other via a rod 115. The hinging clamping element 11 is arranged such that the surface of the clamping piece 112, either in open state or in closed state of the self-closing flood barrier 10, is vertically oriented. The bumper element 121 comprises the top surface of a protruding element 126 which is attached to the top of the forcing element 120, whereby the protruding element 126 is part of the flood barrier element 12. The forcing element 120 may comprise the protruding element 126. The forcing element 120 may substantially comprise the entire flood barrier element 12. Not shown in FIG. 3A are the elements which prevent that the clamping piece hinges downwards in open state of the self-closing barrier, such as, for example, a retractable rod.

Figure 3B:
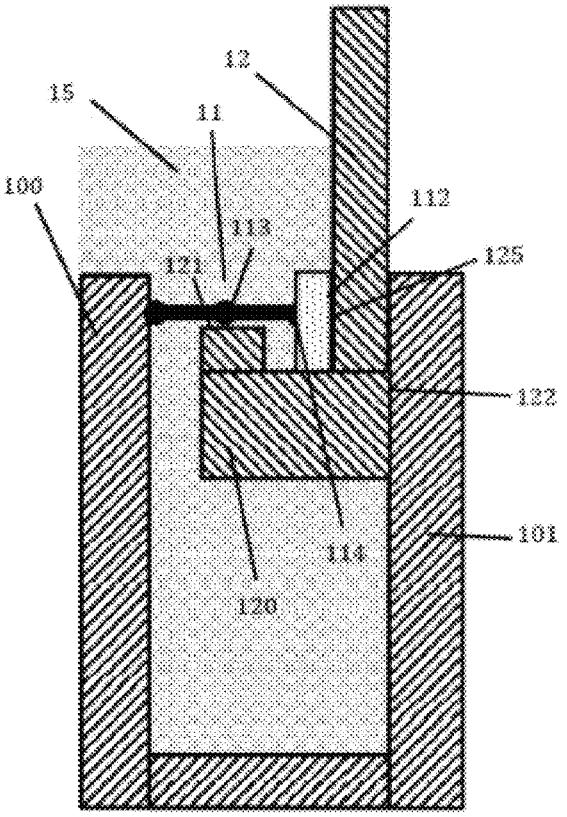

We now refer to FIG. 3B. Water 15 has been let into the housing through the water inlet, which comprises the top of the housing, according to the method according to the second aspect of the present invention. The forcing element 120, and thus the flood barrier element 12, has been forced upwards by the water 15, so that the bumper element 121 has pushed against the pushing element 113. The hinging clamping element 11 has thus been hinged such that the clamping piece 112 has been hinged against the surface 125 of the flood barrier element 12. In this embodiment too, there is a large contact surface between the clamping piece 112 and the surface 125 of the flood barrier element 12, and also between the substantially flat side 122 of the flood barrier element 12 and the hinterland-side wall 101, so that the flood barrier element 12 will not tilt spontaneously with wave motion or at various water levels.

Figure 5:
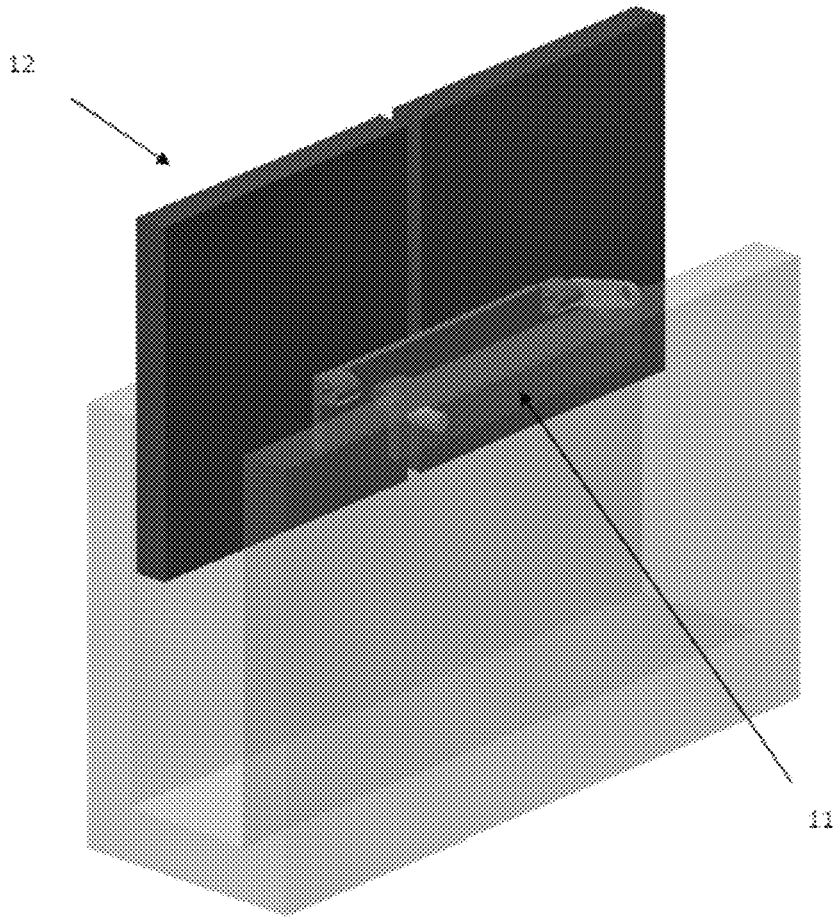
FIG. 5 illustrates a flood barrier element having a forcing element.

While the flood barrier is described, in the above embodiments, as having a flood barrier element which comprises a forcing element, the flood barrier element may also act as forcing element itself so that it creates a forced upward movement of the flood barrier element itself. This has been illustrated in FIG. 5.

The preceding description gives details of certain embodiments of the invention. It will, however, be clear that no matter how detailed the above turns out to be in text, the invention may be applied in many ways. It should be noted that the use of certain terminology when describing certain features or aspects of the invention should not be interpreted as implying that the terminology herein is defined again to be restricted to specific features of the characteristics or aspects of the invention to which this terminology is coupled.

The invention claimed is:

1. A self-closing flood barrier for protecting a hinterland against floods, wherein the self-closing flood barrier comprises:

a housing comprising a water-side wall and a hinterland-side wall;

a water inlet for letting in water into the housing; and a flood barrier element which is movable up and down in the housing, the flood barrier element comprising a forcing element for causing a forced upward movement of the flood barrier element or the flood barrier element acting as forcing element for causing a forced upward movement of the flood barrier element;

wherein the self-closing flood barrier comprises a hinging clamping element which is hinge-mounted to the water-side wall, the hinging clamping element comprising a clamping piece configured to hinge against the flood barrier element by the forced upward movement of the flood barrier element from buoyancy exercised by water; and wherein the flood barrier element is pressed against the hinterland-side wall so that, in a closed state of the self-closing flood barrier, the clamping piece is hinged against the flood barrier element.

2. The self-closing flood barrier according to claim 1, wherein the hinging clamping element comprises a pressure element, wherein the hinging clamping element is arranged such that when the pressure element is pressed, the clamping piece hinges against the flood barrier element.

3. The self-closing flood barrier according to claim 2, wherein the flood barrier element comprises a bumper element, which, in the closed state of the self-closing flood barrier, serves to press against the pressure element.

4. The self-closing flood barrier according to claim 3, wherein pressure element of the hinging clamping element comprises a surface and the bumper element of the flood barrier element comprises a surface, wherein, in closed position of the self-closing flood barrier, said two surfaces touch each other.

5. The self-closing flood barrier according to claim 4, wherein the hinging clamping element, the housing and the flood barrier element are arranged such that the surface of the pressure element and the surface of the bumper element are both oriented approximately horizontally, either in open or in closed state of the self-closing flood barrier.

6. The self-closing flood barrier according to claim 2, wherein the pressure element of the hinging clamping element and the clamping piece of the hinging clamping element are directly connected to each other and are immovable relative to each other.

7. The self-closing flood barrier according to claim 1, wherein the clamping piece comprises a surface and the flood barrier element comprises a surface, wherein, in closed state of the self-closing flood barrier, said surfaces touch each other.

8. The self-closing flood barrier according to claim 7, wherein the hinging clamping element, the housing and the flood barrier element are arranged such that the surface of the clamping piece and the surface of the flood barrier element are both oriented approximately vertically, either in open or in closed position of the self-closing flood barrier.

9. The self-closing flood barrier according to claim 1, wherein the flood barrier element comprises a closing element at the top, which, in open state of the self-closing barrier, closes an upper opening of the housing.

10. The self-closing flood barrier according to claim 1, wherein the flood barrier element comprises a substantially flat side for leaning against the hinterland-side wall of the housing.

11. The self-closing flood barrier according to claim 1, wherein the flood barrier element comprises a sealing element to a side of the flood barrier element which, in closed state of the self-closing barrier, is pressed against the hinterland-side wall.

12. A method for protecting a hinterland against floods by means of a self-closing flood barrier according to claim 1, comprising providing the self-closing flood barrier, installing the self-closing flood barrier below a bottom base surface, and letting water flow into the housing for forcing the flood barrier element upwards.

13. A method for making a self-closing flood barrier for protecting a hinterland against floods according to claim 1, comprising providing the following components:

the housing, the water inlet, the flood barrier element, and the hinging clamping element and assembling said components so that the self-closing flood barrier is formed.

14. A self-closing flood barrier for protecting a hinterland against floods, the self-closing flood barrier comprising:

a housing comprising a water-side wall and a hinterland-side wall;

a water inlet for letting in water into the housing; and a flood barrier element which is movable up and down in the housing;

wherein the flood barrier element includes a forcing element for causing a forced upward movement of the flood barrier element or the flood barrier element acting as forcing element for causing a forced upward movement of the flood barrier element; and wherein the self-closing flood barrier includes a hinging clamping element which is hinge-mounted to the water-side wall, the hinging clamping element comprising a clamping piece which, in closed state of the self-closing flood barrier, is hinged against the flood barrier element, such that the flood barrier element is clamped in between the clamping piece and the hinterland-side wall; and wherein the hinging clamping element comprises a pressure element, the hinging clamping element being arranged such that when the pressure element is pressed, the clamping piece hinges against the flood barrier element.

15. A self-closing flood barrier for protecting a hinterland against floods, the self-closing flood barrier comprising:

a housing comprising a water-side wall and a hinterland-side wall;

a water inlet for letting in water into the housing; and a flood barrier element which is movable up and down in the housing;

wherein the flood barrier element includes a forcing element for causing a forced upward movement of the flood barrier element or the flood barrier element acting as forcing element for causing a forced upward movement of the flood barrier element;

wherein the self-closing flood barrier includes a hinging clamping element which is hinge-mounted to the water-side wall, the hinging clamping element comprising a clamping piece which, in closed state of the self-closing flood barrier, is hinged against the flood barrier element, such that the flood barrier element is clamped in between the clamping piece and the hinterland-side wall;

wherein the clamping piece comprising a surface and the flood barrier element comprising another surface, wherein, in closed state of the self-closing flood barrier, said surfaces of the clamping piece and the flood barrier element touch each other; and wherein the hinging clamping element, the housing and the flood barrier element are arranged such that the surface of the clamping piece and the other surface of the flood barrier element are both oriented approximately vertically, either in open or in closed position of the self-closing flood barrier.

* * * * *